US010010897B2

(12) United States Patent
Espinoza

(10) Patent No.: US 10,010,897 B2
(45) Date of Patent: Jul. 3, 2018

(54) PUMP DISPENSER WITH LOCKING FEATURE

(71) Applicant: WestRock Dispensing Systems, Inc., Norcross, GA (US)

(72) Inventor: Alejandro Espinoza, Overland Park, KS (US)

(73) Assignee: SILGAN DISPENSING SYSTEMS CORPORATION, Grandview, MO (US)

( * ) Notice: Subject to any disclaimer, the term of this patent is extended or adjusted under 35 U.S.C. 154(b) by 58 days.

(21) Appl. No.: 15/214,516

(22) Filed: Jul. 20, 2016

(65) Prior Publication Data

US 2017/0021376 A1 Jan. 26, 2017

Related U.S. Application Data

(60) Provisional application No. 62/194,381, filed on Jul. 20, 2015, provisional application No. 62/204,646, filed on Aug. 13, 2015.

(51) Int. Cl.
*B67B 7/00* (2006.01)
*B05B 11/00* (2006.01)

(52) U.S. Cl.
CPC ..... *B05B 11/3059* (2013.01); *B05B 11/3001* (2013.01); *B05B 11/306* (2013.01); *B05B 11/3025* (2013.01); *B05B 11/3074* (2013.01)

(58) Field of Classification Search
CPC ..... B05B 11/3059; B05B 11/306
USPC ..... 222/153.13, 320–321.9
See application file for complete search history.

(56) References Cited

U.S. PATENT DOCUMENTS 4,512,501 A * 4/1985 Foster ..... B05B 11/3001 222/153.13
5,443,569 A * 8/1995 Uehira ..... B05B 7/0031 222/190
5,445,299 A * 8/1995 Harriman ..... B05B 11/306 215/254
5,549,223 A * 8/1996 Hori ..... B05B 11/0062 222/153.13
5,775,547 A * 7/1998 Foster ..... B05B 11/3061 222/321.3
6,308,865 B1 * 10/2001 Lin ..... B05B 11/3001 222/153.13

(Continued)

FOREIGN PATENT DOCUMENTS

EP 1332978 A2 8/2003
EP 2080711 A1 7/2009

(Continued)

*Primary Examiner* — Frederick C Nicolas
*Assistant Examiner* — Randall Gruby
(74) *Attorney, Agent, or Firm* — Barlow, Josephs & Holmes, Ltd.

(57) ABSTRACT

A pump dispenser includes a dispenser head rotatable relative to a locking ring for a lock-down feature during shipment. The lock-down feature requires a greater torque to initially rotate the dispenser head from the lock-down position, and a lesser torque to further rotate the dispenser head to a use position. The lock-down feature incorporates an interference between the dispenser head and locking ring, either inside the dispenser head, on an outer periphery of the dispenser head, or between threads connecting the dispenser head and locking ring.

8 Claims, 15 Drawing Sheets

(56) References Cited

U.S. PATENT DOCUMENTS 6,357,629 B1 * 3/2002 Ding ..... B05B 11/3047 222/153.13
6,536,630 B1 * 3/2003 Chan ..... B05B 11/3008 222/207
6,604,656 B1 8/2003 Tseng
6,695,176 B1 * 2/2004 Nazari ..... B05B 11/007 222/321.9
6,966,459 B1 * 11/2005 Tseng ..... B05B 11/305 222/153.13
9,687,866 B1 * 6/2017 Chan ..... B05B 11/3001
2002/0092870 A1 * 7/2002 Kim ..... B05B 11/305 222/321.9
2004/0062667 A1 * 4/2004 Ding ..... B05B 11/0016 417/435
2005/0085927 A1 11/2005 Oh
2007/0045349 A1 * 3/2007 Foster ..... B05B 11/3023 222/321.9
2008/0290119 A1 * 11/2008 Tseng ..... B05B 11/3001 222/321.7
2009/0127291 A1 * 5/2009 Corbellini ..... B05B 11/3015 222/321.8
2009/0200258 A1 8/2009 Maeda
2009/0314805 A1 * 12/2009 Ding ..... B05B 11/306 222/153.13
2010/0006604 A1 1/2010 Ding
2010/0230443 A1 * 9/2010 Ding ..... B05B 11/3001 222/321.9
2011/0095055 A1 * 4/2011 Kakuta ..... B05B 11/3046 222/321.9
2015/0136810 A1 * 5/2015 Ding ..... B05B 11/3002 222/321.9
2015/0251203 A1 * 9/2015 Wang ..... B05B 11/3001 222/153.13
2017/0128966 A1 * 5/2017 Law ..... B05B 11/0027

FOREIGN PATENT DOCUMENTS

WO WO 02/04129 1/2002
WO WO 2004-007310 1/2004
WO WO 2007-085927 8/2007
WO WO 2016/009187 1/2016

* cited by examiner

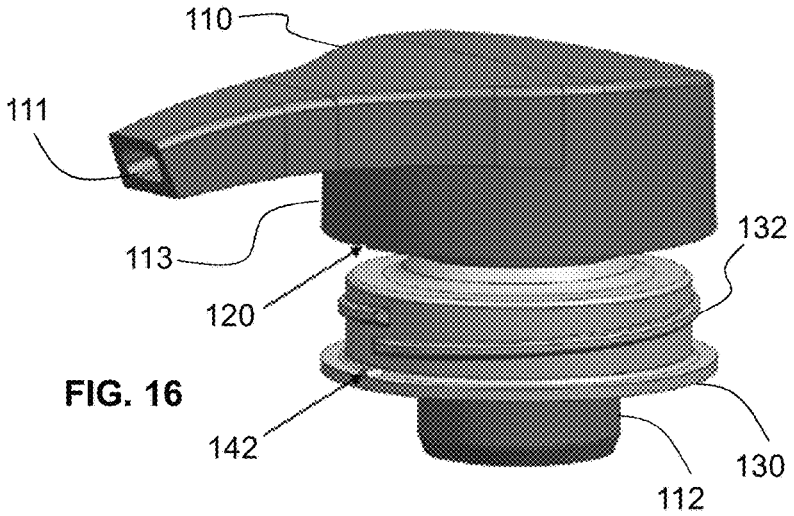
FIG. 16
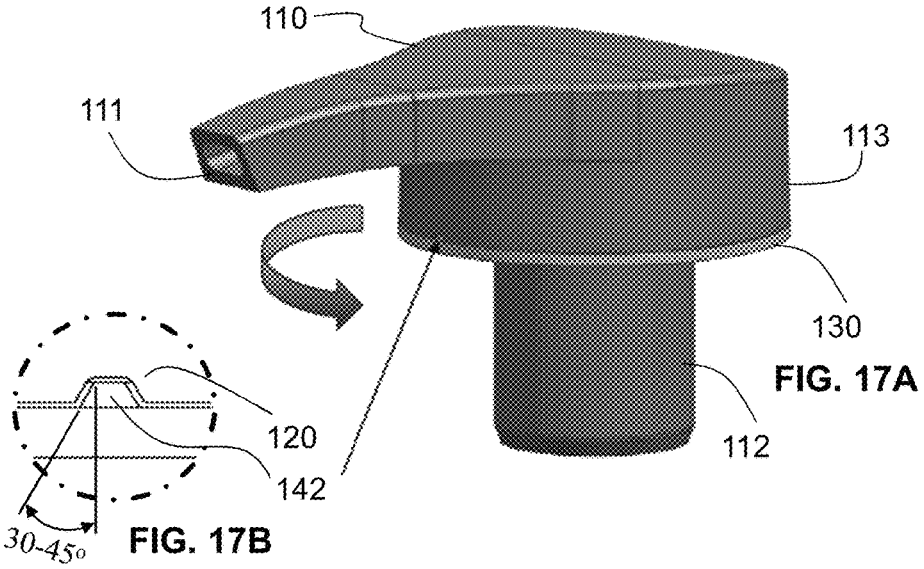
FIG. 17A
FIG. 17B

PUMP DISPENSER WITH LOCKING FEATURE

BACKGROUND OF THE INVENTION

Field of the Invention

Embodiments of the invention relate to pump-type dispensers and more particularly to lock-down features for such dispensers, including lock-down features involving a yieldable interference fit which requires a greater torque to start rotation from a fully locked position, than to rotate the dispenser to an unlocked, use position.

State of the Art

Lock-down and lock-up features are known for various types of dispensers. The lock features provide some resistance against children opening the dispensers, but they also prevent leaking during shipping from the manufacturer to the consumer.

When dispensers are shipped to retail stores, the shipments are often in case lots where many units are packaged inside heavy corrugated cartons. Such cartons help protect the product during shipment. If the lock-down (or lock-up) feature involves a rotation of the pump head, such rotation might be generally avoided when shipping is within heavy packaging. With the advent of online shopping (sometimes known as "e-commerce") it has become more common for small quantities of dispensers to be shipped directly to a customer's home. Often the packaging for such e-commerce sales is not as robust as the corrugated cartons that may be used for large lots of product. Conventional locking features may not adequately protect the dispenser contents from opening or leaking during shipment. Dispensers with rotatable heads may experience unlocking, opening, and leakage. There remains a need for a dispenser with a strong locking action to provide good product security during shipment and especially for e-commerce use.

BRIEF SUMMARY OF THE INVENTION

A fluid dispenser includes a dispenser head adapted for remaining securely closed during shipping and handling. The dispenser head is rotatable between a lock-down position and an unlocked position, and rotation of the dispenser head in the vicinity of the lock-down position requires a greater torque than rotation of the dispenser head apart from the lock-down position.

The greater torque required to rotate from the lock-down position may be due to an interference of parts. In certain embodiments, the interference may be between a protrusion on the one part and a groove on another part. In other embodiments, the interference may be between a ramped protrusion and a rib. In still other embodiments, the interference may be between a first thread and a second thread, where one or both threads include a locally nonuniform thread size or a locally nonuniform thread pitch. In other embodiments, a locking ring may be frangibly connected to the dispenser head and may be broken loose in order to unlock the dispenser. The frangible connection itself may be considered an interference fit. In other embodiments, one or more latches may prevent the dispenser head from rotating until the latches are released.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

FIG. 16 is a perspective view of certain parts of the dispenser head of FIG. 10 in an open position;

FIG. 17A is a perspective view of certain parts of the dispenser head of FIG. 10 in a closed, locked position;

FIG. 17B is a detail view from FIG. 17A;

DETAILED DESCRIPTION OF THE INVENTION

Figure 1:
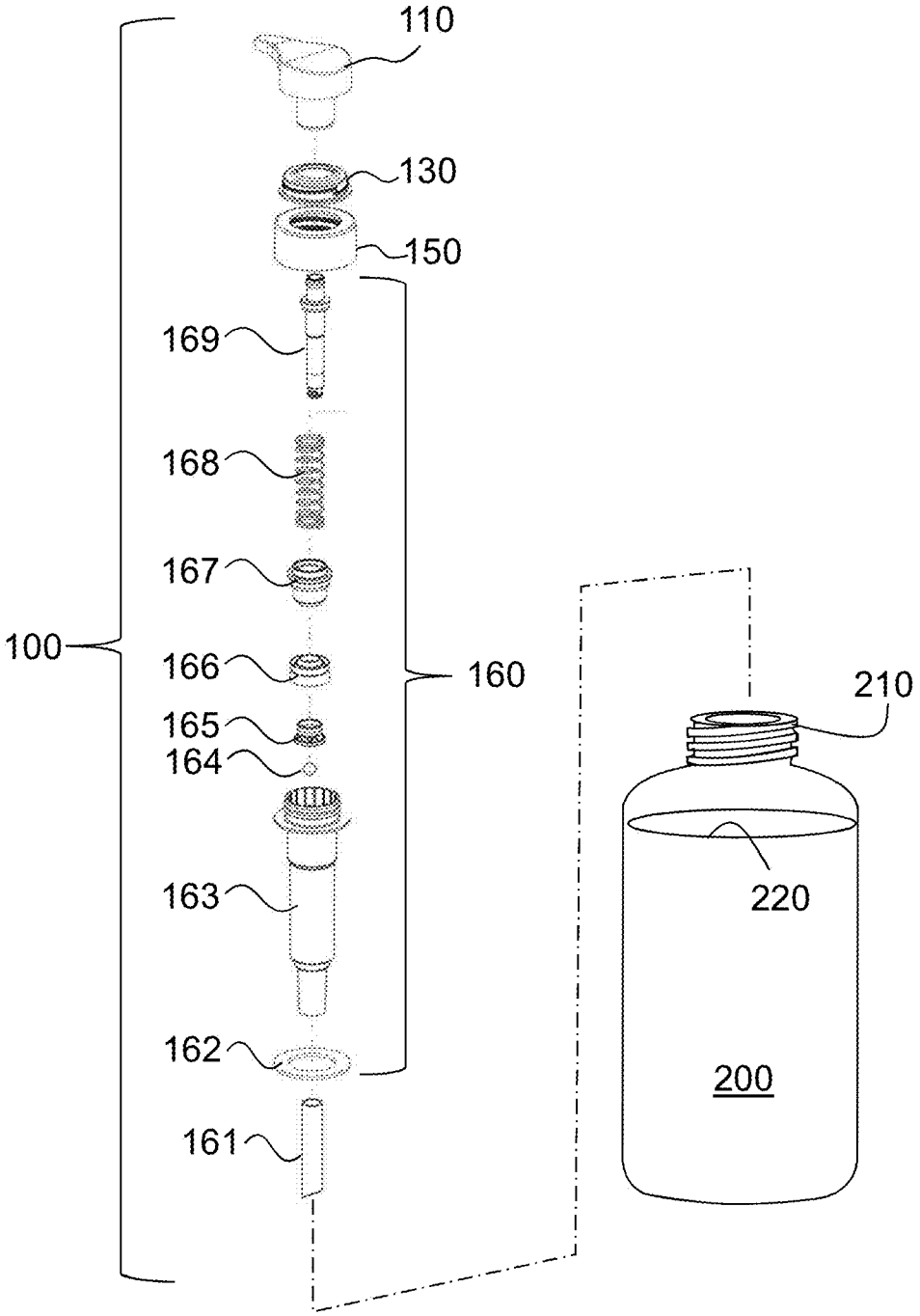
FIG. 1 is an exploded perspective view of the parts of a dispenser, include a dispenser head.

As shown generally in FIGS. 1-34, embodiments of the present invention are generally directed to a dispensing closure for pump-type dispensers. As shown in FIG. 1, a pump dispenser 100 may be attached to a container 200 holding a fluid 220 to be dispensed. The pump dispenser 100 may include, from top to bottom, a dispenser head 110, a chaplet or locking ring 130, a container closure 150, and a pump engine 160. Container closure 150 may fit onto the mouth 210 of a container 200, for example by a threaded connection as shown, or by other methods such as a bayonet or snap-on closure. Parts of the pump engine 160 may include a piston stem 169, spring 168, lock cylinder 167, piston seal 166, dispenser seal 165, ball valve 164, accumulator 163, gasket 162, and dip tube 161. The dip tube 161 may extend into the container 200. Pump dispenser 100 may pump liquid 220 from the container 200. Pump dispenser 100 may be provided with lock-down features as described in the following paragraphs.

Various elements may be included in the pump dispenser that require a greater unlocking torque T1 when rotating the dispenser head from a locked position to an unlocked position, than the usual torque T2 required when rotating the dispenser head from an unlocked position to an open or use position. These elements may include an interference fit between certain parts of the dispenser head. By "interference fit" is meant a physical interaction between the shapes of the parts that locally requiring a greater torque to rotate the dispenser head. Thus the interaction between the parts may cause a tighter lock condition, or a "ship-tight" condition, or an anti-rotate, anti-twist, or anti-turn condition.

Figure 2:
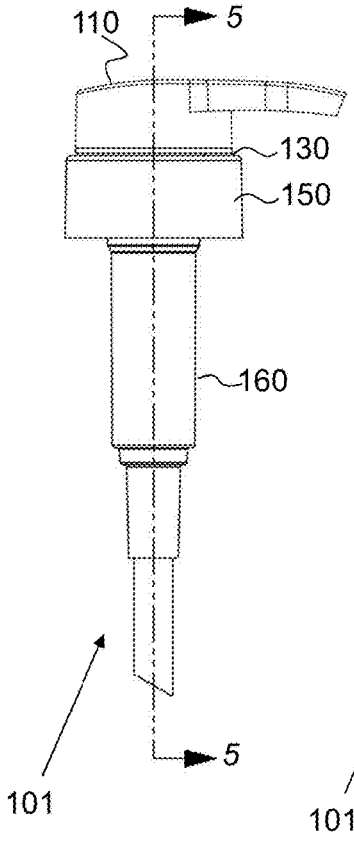
FIG. 2 is a side view of the dispenser head of FIG. 1 in a closed, locked position.
Figure 3:
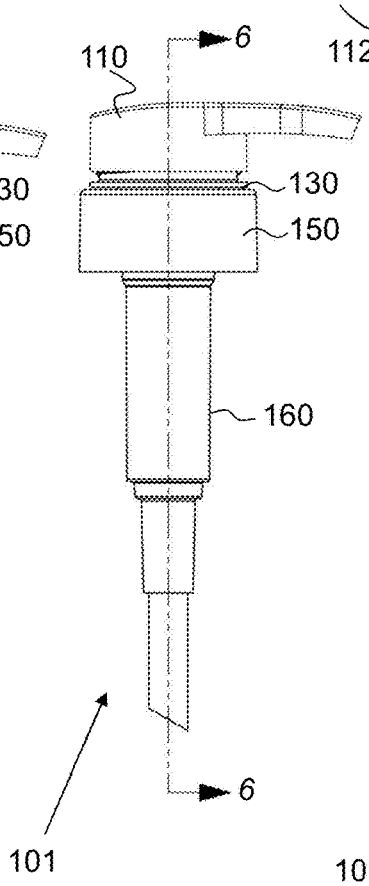
FIG. 3 is a side view of the dispenser head of FIG. 1 in a closed, unlocked position.
Figure 4:
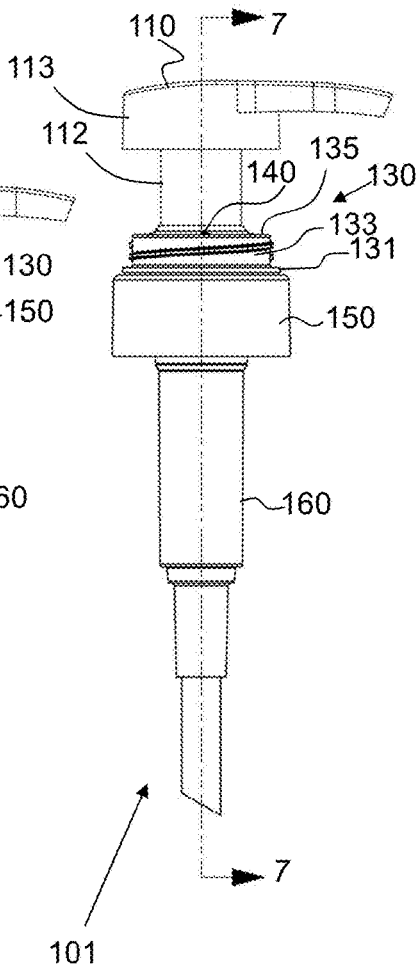
FIG. 4 is a side view of the dispenser head of FIG. 1 in an open position.

FIGS. 2-4 show side views of a first pump dispenser 101 with locking feature in three positions: closed and locked-down, unlocked, and open or use position. To move from the closed/locked to the unlocked position, dispenser head 110 is rotated sufficiently with respect to locking ring 130 so that the dispenser is unlocked. Further rotation of dispenser head 110 brings it to a fully open position. Particularly in FIG. 4, certain features are denoted including dispenser head depending skirt 113 and dispenser head outer barrel 112. Locking ring 130 may include a lower rim 131, a cylindrical wall 133, and an upper rim 135.

An interference fit may be provided by a protrusion such as locking ramp 140 shown on the upper rim 135 of locking ring 130. The operation of the locking ramp will be explained further with regard to the cross section views of FIGS. 5-7, which correspond to the side views of FIGS. 2-4.

Figures 5, 6, 7:
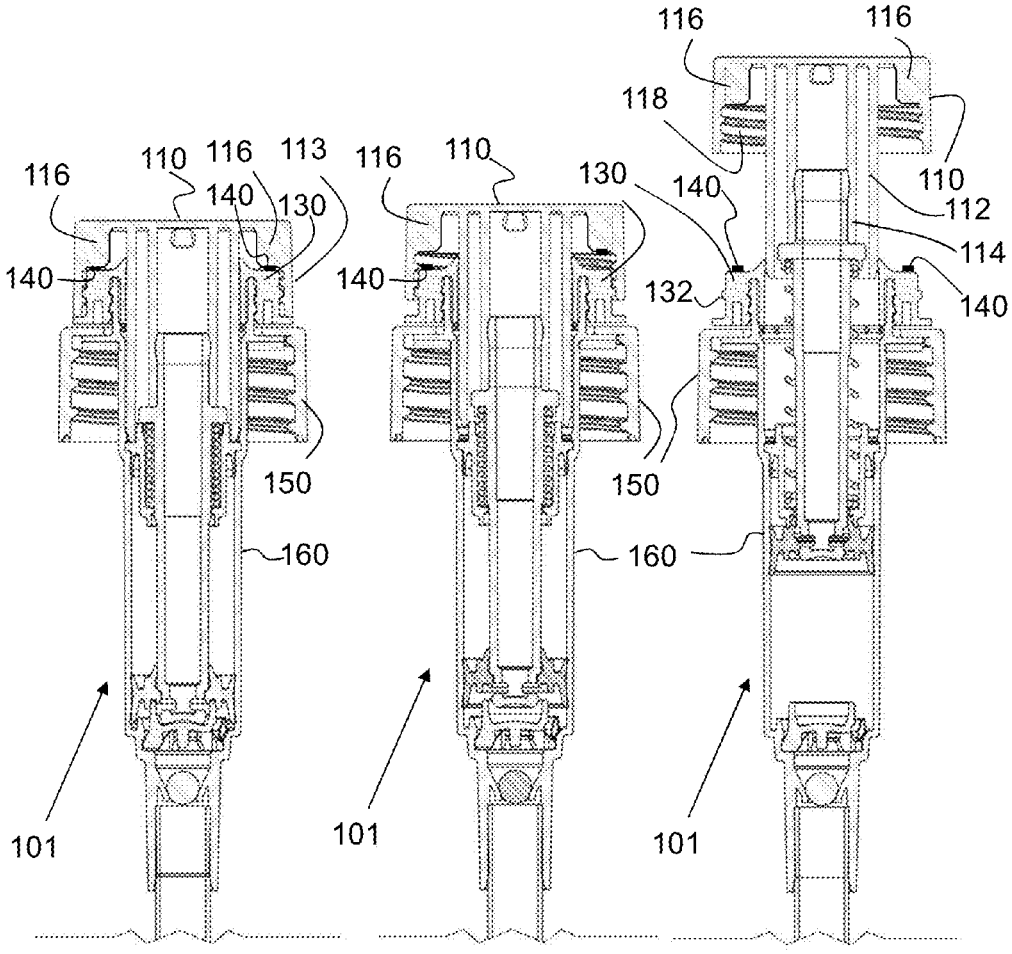
FIG. 5 is a cross section of the FIG. 2 closed, locked position.
FIG. 6 is a cross section of the FIG. 3 closed, unlocked position.
FIG. 7 is a cross section of the FIG. 4 open position.

As shown in the closed, locked position of FIG. 5, locking ramp 140 on locking ring 130 may engage a locking rib 116 on the underside of dispenser head 110. The engagement of locking ramp 140 and locking rib 116 may occur at or near the point where the dispenser head 110 has been rotated completely downward on threads 118, 132. To engage or disengage locking ramp 140 and locking rib 116 may require more torque than is needed for otherwise rotating the dispenser head 110 on the locking ring 130. As a non-limiting example, the torque required to disengage locking ramp 149 and locking rib 116 may be about 13 inch-lbs. After the locking features are disengaged, the torque for further rotation of the dispenser head 110 on the locking ring 130 may be about 2 inch-lbs. The extra torque for disengaging the locking feature may need only to be exerted for a few degrees of rotation before the locking feature is disengaged. As a non-limiting example, the extra torque may be required for only about 2-5 degrees of rotation. The locking features may include a single locking ramp 140 and locking rib 116. However, multiples of these features may also be utilized, such as one or more additional locking ramps and locking ribs for example on opposite sides of the dispenser or spaced around the circumference. One locking rib 116 may be used with more than one locking ramp 140, or one locking ramp 140 may be used with more than one locking rib 116.

FIG. 6 shows the dispenser in an unlocked position where the dispenser head 110 has been rotated sufficiently to disengage the locking rib 116 and locking ramp 140. FIG. 7 shows the dispenser in an open condition where the dispenser head 110 has been rotated completely upward until threads 118, 132 disengage to free the dispenser head 110 from locking ring 130 and allow the spring 168 to extend the dispenser head into readiness for dispensing product. The dispenser may be closed and locked again by pressing down on the dispenser head 110 until threads 118, 132 may be reengaged and the dispenser head twisted down on the threads until the locking rib 116 and locking ramp 140 are again engaged.

Figure 8A:
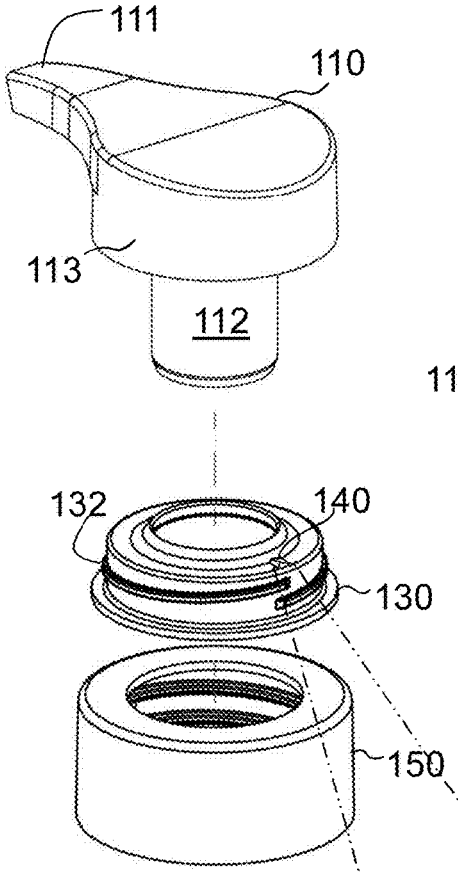
FIG. 8A is an exploded perspective view of certain parts of the dispenser head of FIG. 1.
Figure 9:
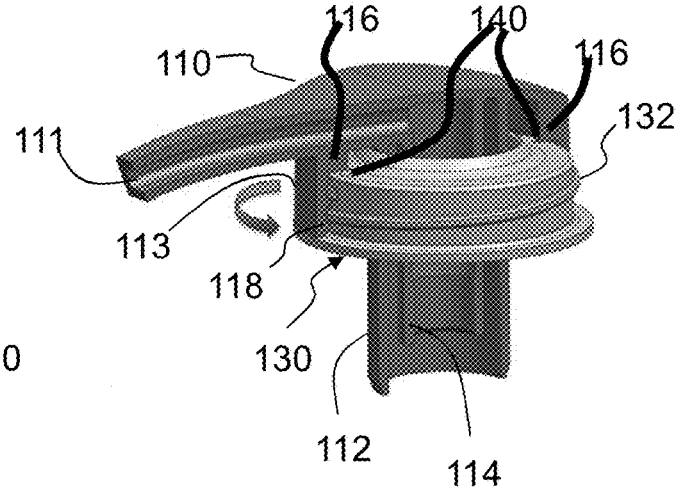
FIG. 9 is a partial cross section view of certain parts of the dispenser head of FIG. 1 in a closed, locked position.

FIG. 8A shows a perspective view of the dispenser head 110, locking ring 130 with associated locking ramp 140, and container closure 150. FIG. 9 shows a partial cutaway of the dispenser head 110 and locking ring 130, including two locking ramps 140 on the locking ring 130, and two locking ribs 116 on the underside of dispenser head 110. Also seen in this view are the dispenser head outer barrel 112 and inner barrel 114 including a fluid inlet, and the fluid outlet 111 in the dispenser head 110. The dispenser head 110 may rotate approximately one turn from the locked position of FIG. 9 to the open position. The locking ramps 140 may be shaped so that a greater torque is required to rotate from the locking position to the unlocked position, than is required to rotate the dispenser head through most of the travel between the unlocked and open positions. The locking ramps 140 may be shaped to require a greater torque to rotate the dispenser head 110 from the locked position to the unlocked position, than to rotate the dispenser head 110 from the unlocked position back to the locked position.

Figure 8B:
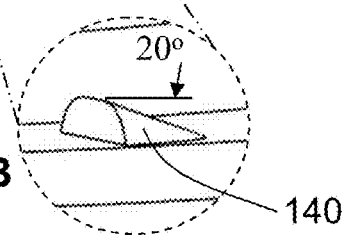
FIG. 8B is a detail view from FIG. 8A.

FIG. 8B shows a detail view of the locking ramp 140. As non-limiting examples, locking ramp 140 may have a width (radial direction) between 1.5-3.5 mm (about 0.060" to 0.140"), and a height between 0.4 to 1.5 mm (about 0.015" to 0.060"). The slope of locking ramp 140 may be approximately 20 degrees. Locking rib 116 may have a thickness between 0.5 to 1.5 mm (about 0.020" to 0.060").

Figures 10, 11, 12:
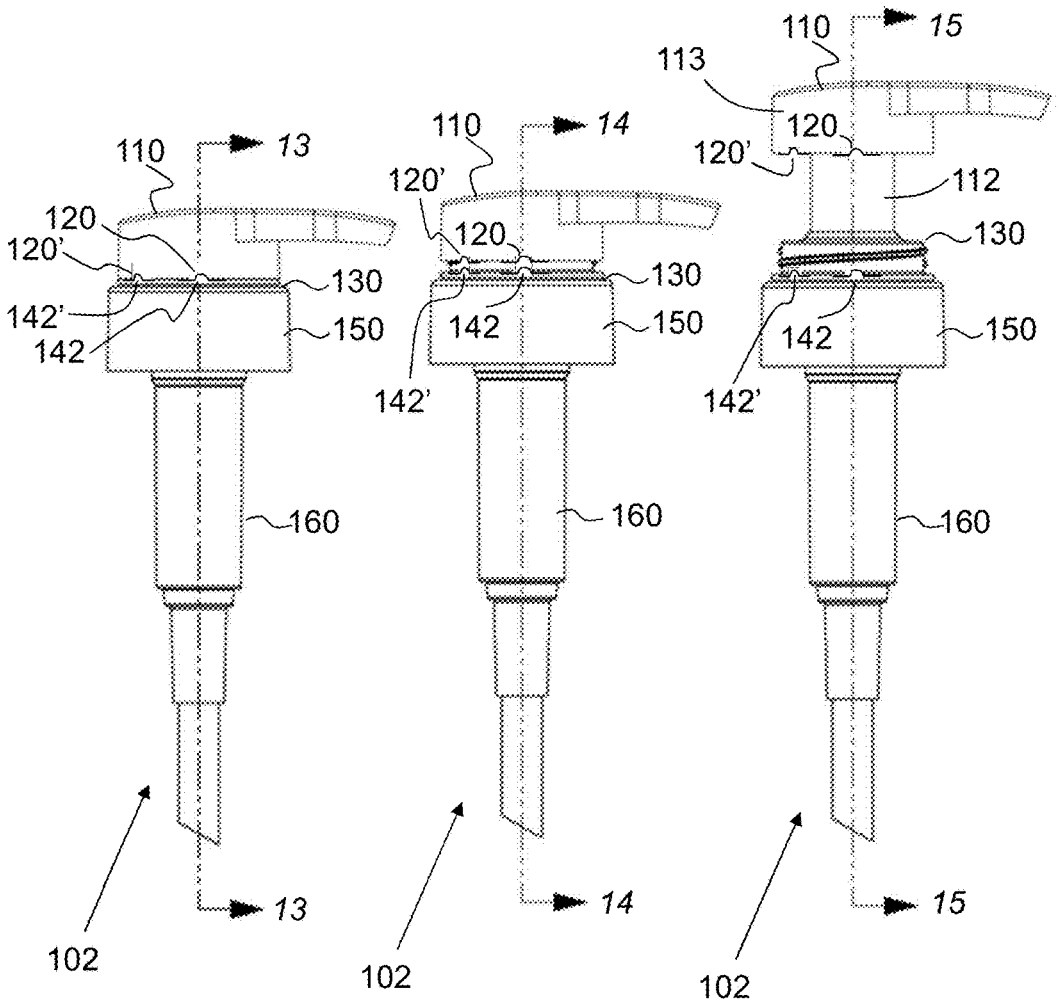
FIG. 10 is a side view of another dispenser head in a closed, locked position.
FIG. 11 is a side view of the dispenser head of FIG. 10 in a closed, unlocked position.
FIG. 12 is a side view of the dispenser head of FIG. 10 in an open position.
Figure 13:
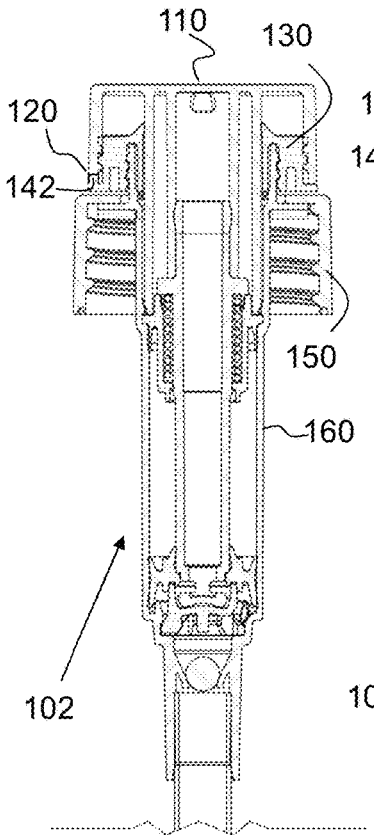
FIG. 13 is a cross section of the dispenser head of FIG. 10 in a closed, locked position.
Figure 14:
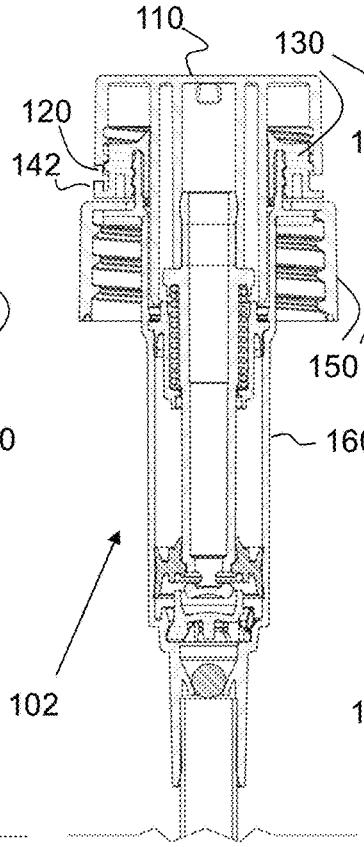
FIG. 14 is a cross section of the dispenser head of FIG. 11 in a closed, unlocked position.
Figure 15:
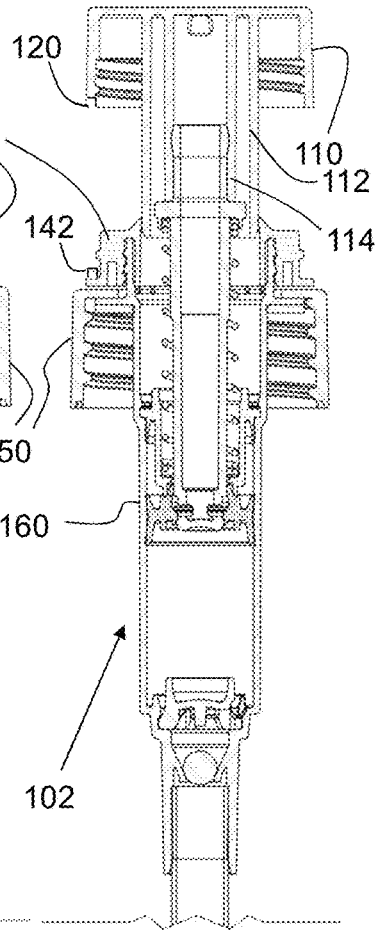
FIG. 15 is a cross section of the dispenser head of FIG. 12 in an open position.

Another pump dispenser 102 with a different locking feature is shown in FIGS. 10-17. FIGS. 10-12 show side views in three positions respectively: a closed, locked position, an unlocked position, and a fully open/use position. Corresponding cross-section views are seen in FIGS. 13-15. To move from the closed, locked position the dispenser head 110 is rotated sufficiently with respect to locking ring 130 so that the dispenser is unlocked. Further rotation then brings the dispenser to a fully open position.

According to various embodiments of the invention, a locking feature be provided as an interference fit in which a locking bump 142 as shown at the lower rim 131 of locking ring 130, may engage a locking groove 120 at the base of depending skirt 113 of dispenser head 110. The operation of the locking bump 142 will be explained further with regard to the cross section views of FIGS. 13-15.

As shown in the closed, locked position of FIG. 13, locking bump 142 on locking ring 130 may engage locking groove 120 on the lower edge of depending skirt 113 of dispenser head 110. The engagement of locking bump 142 and locking groove 120 may occur at or near the point where the dispenser head 110 has been rotated completely downward on threads 118, 132. To engage or disengage locking bump 142 and locking groove 120 may require more torque than is needed for otherwise rotating the dispenser head 110 on the locking ring 130. As a non-limiting example, the torque required to disengage a locking bump 142 and locking groove 120 may be about 13 inch-lbs. One the unlocking feature is disengaged, the torque required to rotate the dispenser head 110 on locking ring 130 may be only about 2 inch-lbs. The extra torque for disengaging the locking feature may only need to be exerted for a short angle until the locking feature is disengaged. As a non-limiting example, the extra torque may be required for only about 2-5 degrees of rotation. The locking feature may include a single locking bump 142 and locking groove 120. However, multiples of these features may also be utilized, such as one or more additional locking bumps 142' and locking grooves 120' for example on opposite sides of the dispenser or spaced around the circumference. One locking bump 142 may be used with more than one locking groove 120, or one locking groove 120 may be used with more than one locking bump 142.

FIG. 14 shows the dispenser in an unlocked position where the dispenser head 110 has been rotated sufficiently to disengage the locking groove 120 and locking bump 142. FIG. 15 shows the dispenser in an open condition where the dispenser head 110 has been rotated completely upward until threads 118, 132 disengage to free the dispenser head 110 from locking ring 130 and allow spring 168 to extend the dispenser head into readiness for dispensing product. The dispenser may be closed and locked again by pressing down on the dispenser head 110 until threads 118, 132 may be reengaged and the dispenser head twisted down on the threads until the locking bump 142 and locking groove 120 are again engaged.

FIG. 16 shows a perspective view in an open position including locking groove 120 and locking ring 130 with associated locking bump 142. FIG. 17A shows a perspective view in a closed, locked position with locking groove 120, locking ring 130 with associated locking bump 142. In the locked position of FIG. 17A, the locking bump 142 is engaged with the locking groove 120.

FIG. 17B shows a detail view of the locking groove 120 and locking bump 142. As non-limiting examples, the locking bump 142 may have a trapezoidal shape with a wider base and a narrow top. The locking bump may have a height between 0.5 to 1.5 mm (about 0.020" to 0.060") and the locking bump may have a top that extends in the circumferential direction between 0.6-1.5 mm (about 0.024" to 0.060"). The slope of the locking ramp sides may be approximately 30-45 degrees from vertical.

Figure 18:
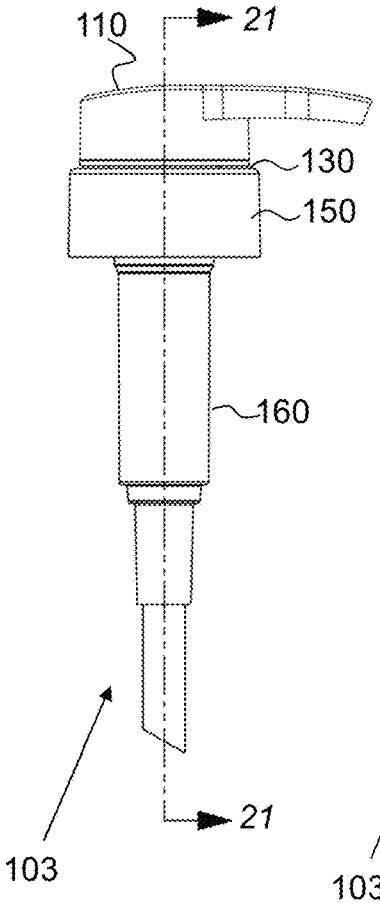
FIG. 18 is a side view of yet another dispenser head in a closed, locked position.
Figure 19:
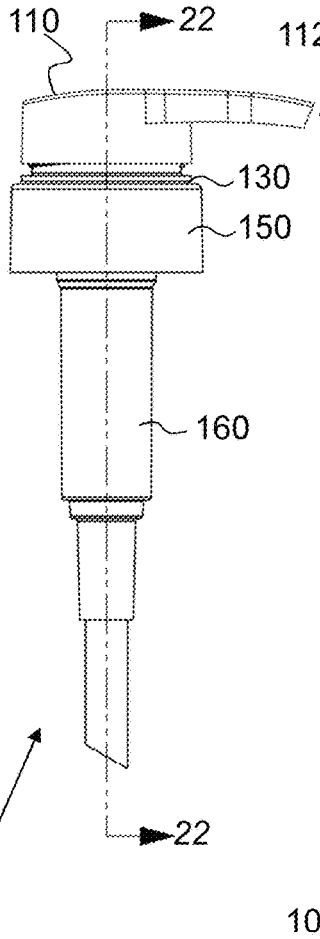
FIG. 19 is a side view of the dispenser head of FIG. 18 in a closed, unlocked position.
Figure 20:
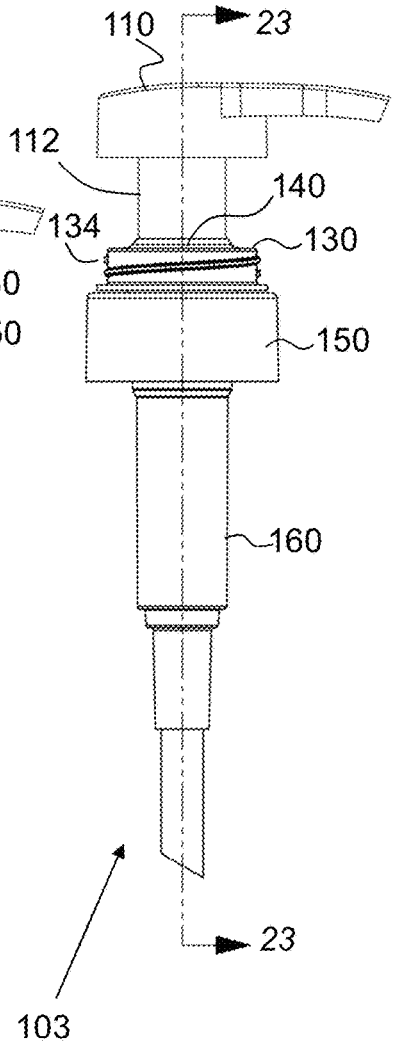
FIG. 20 is a side view of the dispenser head of FIG. 18 in an open position.
Figures 21, 22, 23:
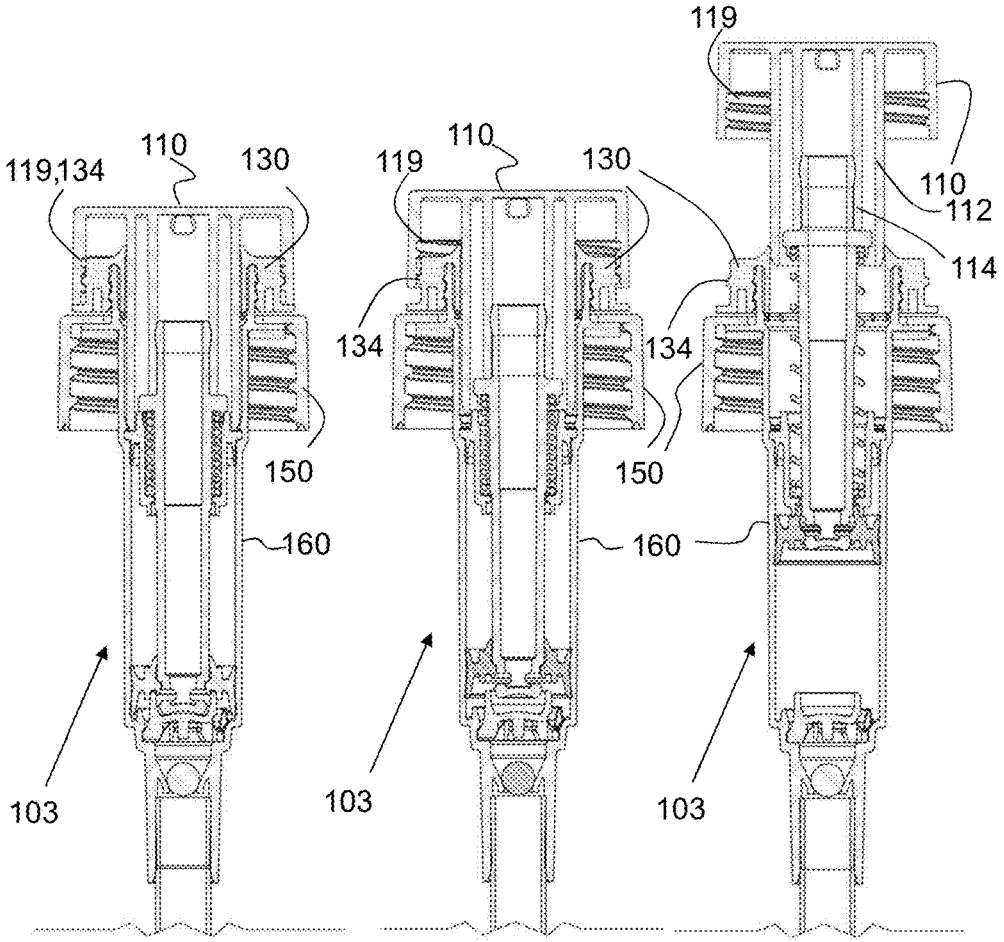
FIG. 21 is a cross section of the dispenser head of FIG. 18 in a closed, locked position.
FIG. 22 is a cross section of the dispenser head of FIG. 19 in a closed, unlocked position.
FIG. 23 is a cross section of the dispenser head of FIG. 20 in an open position.

A pump dispenser 103 with a third type of locking feature is shown in FIGS. 18-24. FIGS. 18-20 respectively show side views of closed, locked-down position, an unlocked position, and an open position. Corresponding cross section views are shown in FIGS. 21-23. To move from the locked position the dispenser head 110 is rotated sufficiently with respect to locking ring 130 until threads 118, 132 disengage to free the dispenser head 110 from locking ring 130 and allow spring 168 to extend the dispenser head into readiness for dispensing product. The dispenser may be closed and locked again by pressing down on the dispenser head 110 until threads 118, 132 may be reengaged and the dispenser head twisted down on the threads until the thread interference (described below) is again engaged so that the dispenser is locked.

Figure 24:
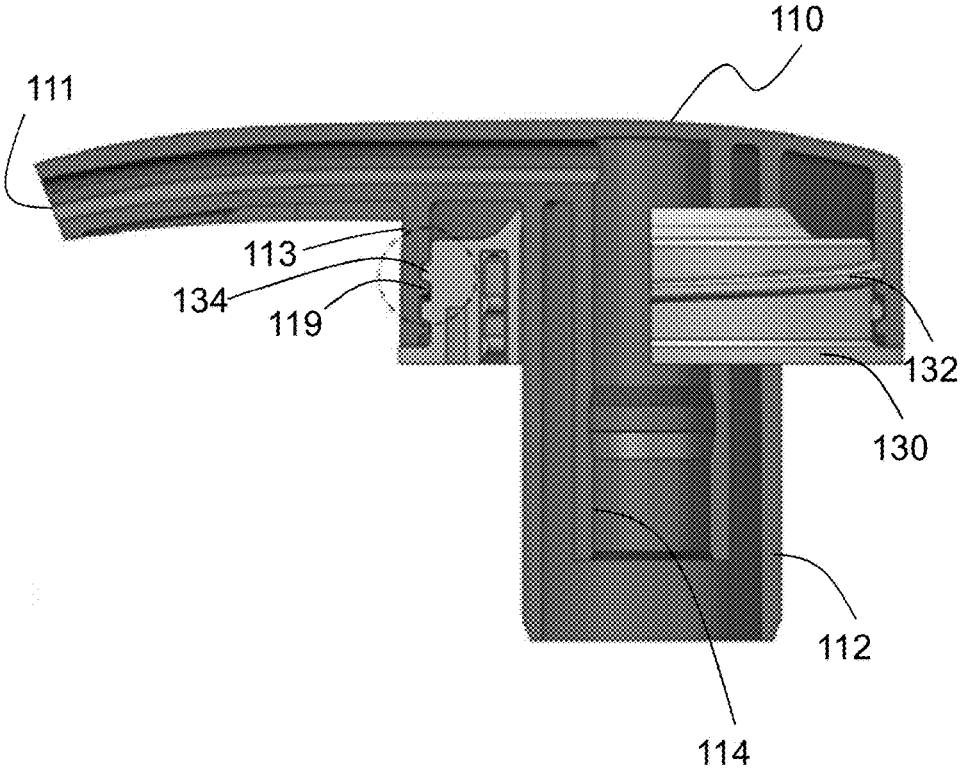
FIG. 24 is a partial cross section view of certain parts of the dispenser head of FIG. 18 in a closed; locked position.

FIG. 24 shows a partial cross section view in a locked position of the dispenser head 110 and locking ring 130.

In the version of the pump dispenser 103 shown in FIGS. 18-24, the locking feature may include a thread interference fit between a portion of threads 132 on the locking ring 130, and threads 118 on the dispenser head 110. For example the thread interference fit may occur between the threads only when the dispenser head 110 is in the closed, locked position of FIGS. 24 and 27. One example for achieving this is to have the upper end portions 119, 134 of threads 118, 132 respectively fit more tightly together than elsewhere on threads 118, 132.

By an "thread interference fit" of the threads is meant a mismatch in the thread fit which may require a greater torque to twist the threads relative to another, compared with the torque required to twists the threads relative to one another during most of the rotation of the dispenser head 110 relative to locking ring 130. As a non-limiting example, the torque required to disengage the mis-fit threads may be about 5 inch-lbs, over about 2-5 degrees of rotation. After disengaging the mis-fit threads, the torque to continue rotation of the dispenser head 110 relative to the locking ring 130 may be only about 2 inch-lbs.

The upper end portions 119, 134 may only engage each other when the dispenser head is in the down/closed/locked position. However, since the upper end portion 134 of threads 132 on the locking ring may engage through most of the rotational travel of the dispenser head 110, it may be advantageous to form a thread interference fit only on the upper end portion 119 of thread 118 on the dispenser head 110. Therefore upper end portion 119 may have a groove portion that is slightly narrower than usual, or a ridge portion that is slightly wider than usual, either of which may form an interference with the upper end portion 134. Alternately the upper end portion 119 may depart from the uniform helical path elsewhere on thread 118, in order to form an interference fit with the upper end portion 134. Therefore the thread interference fit between the threads 119, 134 may be either a locally non-uniform size of one or both threads, or a locally non-uniform spiral path of one or both threads.

Another example for achieving a thread interference fit between threads 132, 118 would be to have their lower end portions respectively fit more tightly together than elsewhere on threads 118, 132. Since the lower end portion of thread 118 on the dispenser head may engage through most of the rotational travel of the dispenser head 110, it may be advantageous to form a thread interference fit only on the lower end portion of thread 132 on the locking ring 130. Therefore the lower end portion of thread 132 may have a groove portion that is slightly narrower than usual, or a ridge portion that is slightly wider than usual, either of which may form a thread interference with the lower end of thread 132. Alternately the lower end portion of thread 132 may depart from the uniform helical path elsewhere on thread 132, in order to form a thread interference fit with the lower end of thread 118.

As shown in the closed, locked position of FIG. 21, upper end portion 134 of thread 132 on locking ring 130 may have a thread interference fit with the upper end portion 119 of thread 118 on the dispenser head 110. This thread interference fit may occur at or near the point where the dispenser head 110 has been rotated completely downward on threads 118, 132. Rotating the dispenser head at this extreme may require more torque than is needed for otherwise rotating the dispenser head 110 on the locking ring 130. This may provide added resistance against accidental opening and leakage. However, the extra torque may only need to only be exerted until the locking feature is disengaged.

Figure 25:
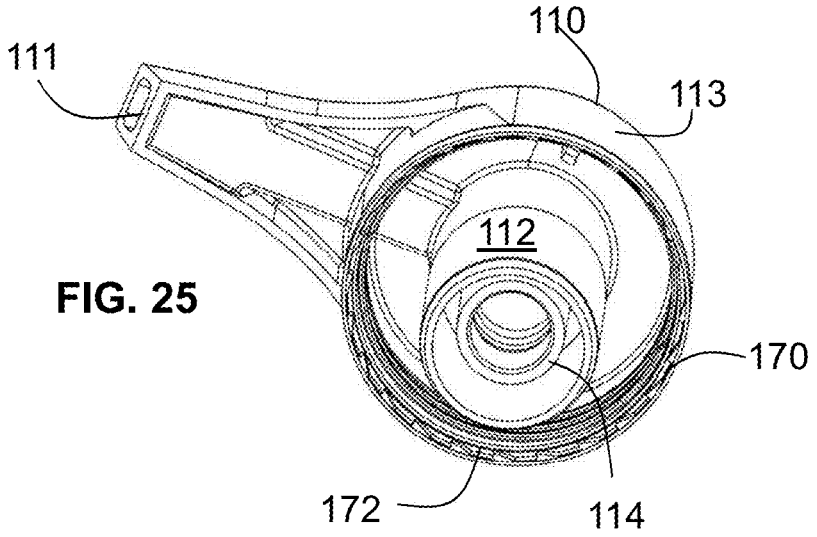
FIG. 25 is a perspective view from below of another dispenser head.
Figure 26:
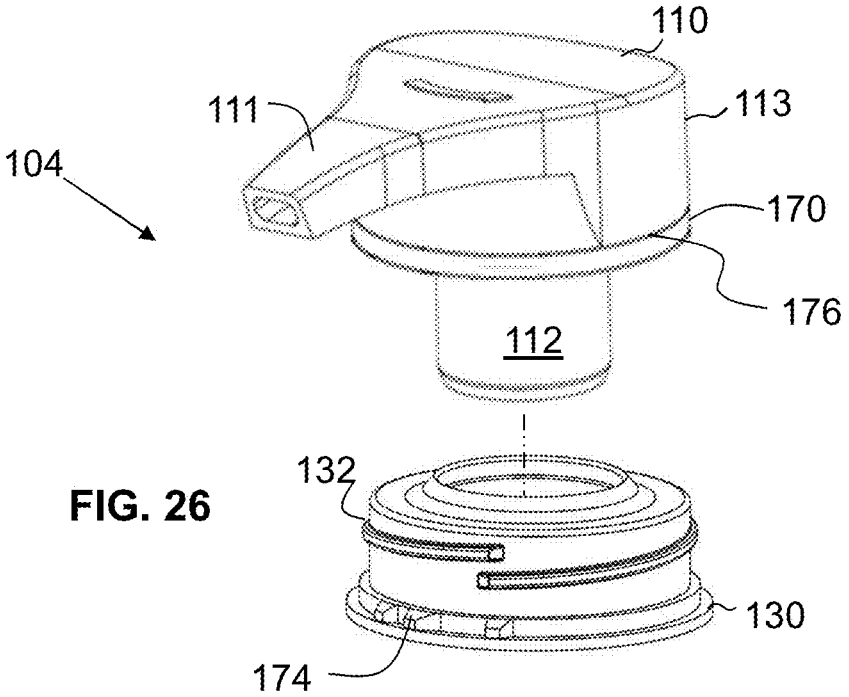
FIG. 26 is a perspective view from the front of the dispenser head of FIG. 25 along with a locking ring.

FIG. 25 shows a perspective view of another dispenser head 110 that initially is formed with a tear ring 170 on its lower edge. The tear ring 170 may be connected to the dispenser head depending skirt 113 by several tear ribs 176. The tear ring 170 may have on its internal edge a plurality of ring ratchets 172. When the dispenser head 110 is initially threaded onto locking ring 130 shown in FIG. 26, the ring ratchets 172 will ride over retention ribs 174 provided on the locking ring 130. Thereafter, the dispenser head 110 cannot be rotated with respect to the locking ring 130 until enough torque is applied to break the tear ribs 176. This provides a lock-down capability during shipment, and also a tamper-evidence feature as it will be readily apparent if the tear ribs 176 have been broken.

Figure 27:
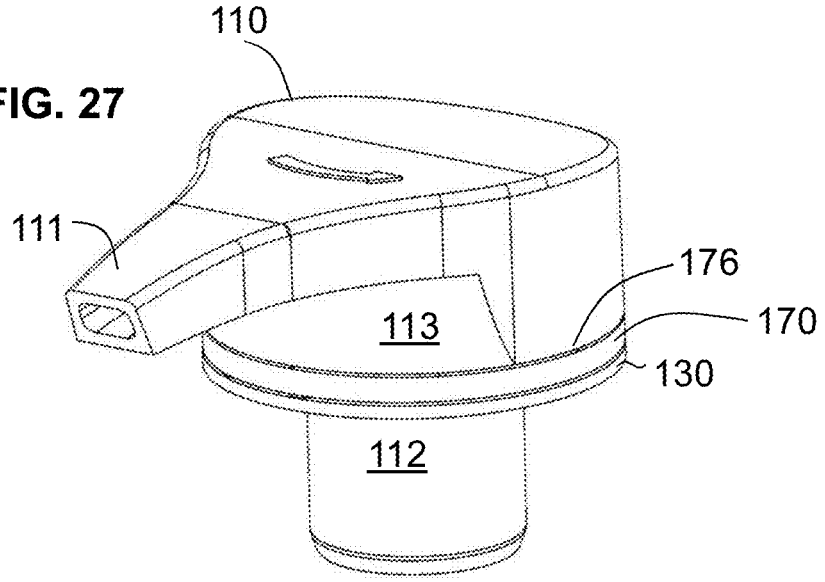
FIG. 27 is a perspective view of the dispenser head of FIG. 26 assembled onto the locking ring.
Figure 28:
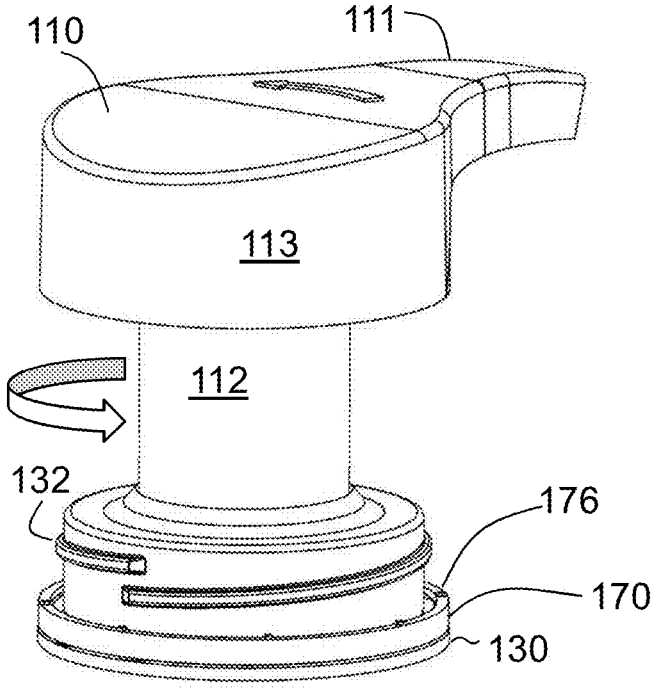
FIG. 28 is a perspective view of the dispenser head of FIGS. 25-27, is an open position.

FIG. 27 shows the dispenser head 110 assembled onto the locking ring 130. FIG. 28 shows the dispenser head after it has been rotated upward from locking ring 130. The tear ring 170 is held on locking ring 130 by the ring ratchets 172, so the applied torque to initially unlock the dispenser head causes the tear ribs 176 to break and sever the connection between the locking ring 130 and the dispenser head depending skirt 113.

The tear ring 170 may be used with other of the dispenser heads here to provide a tamper evident feature and/or additional security against unintentional unlocking of the dispenser head.

Figure 29:
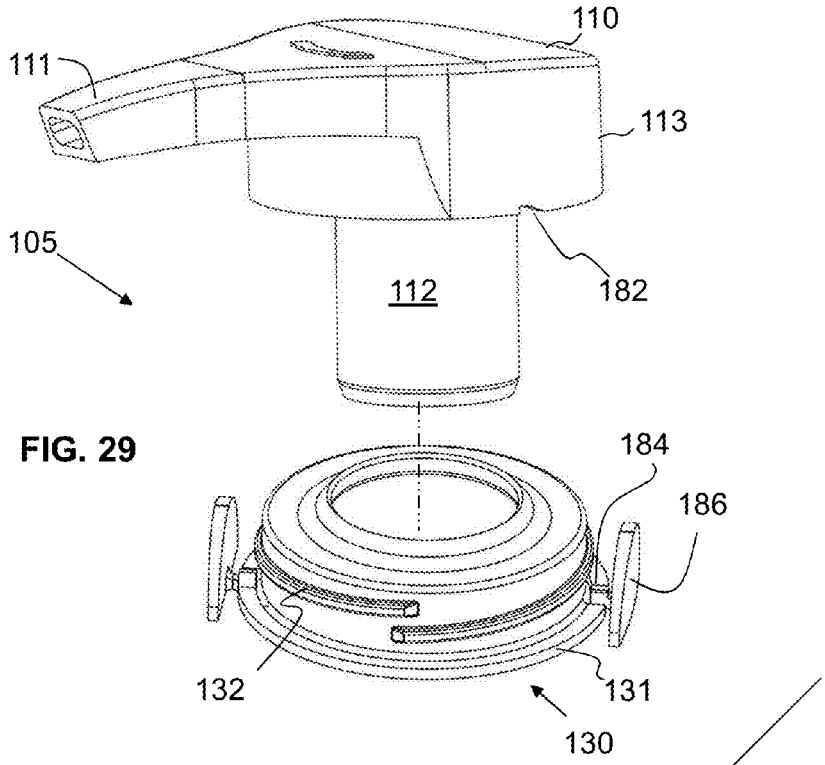
FIG. 29 is a perspective view from the side of another dispenser head and locking ring.
Figure 30:
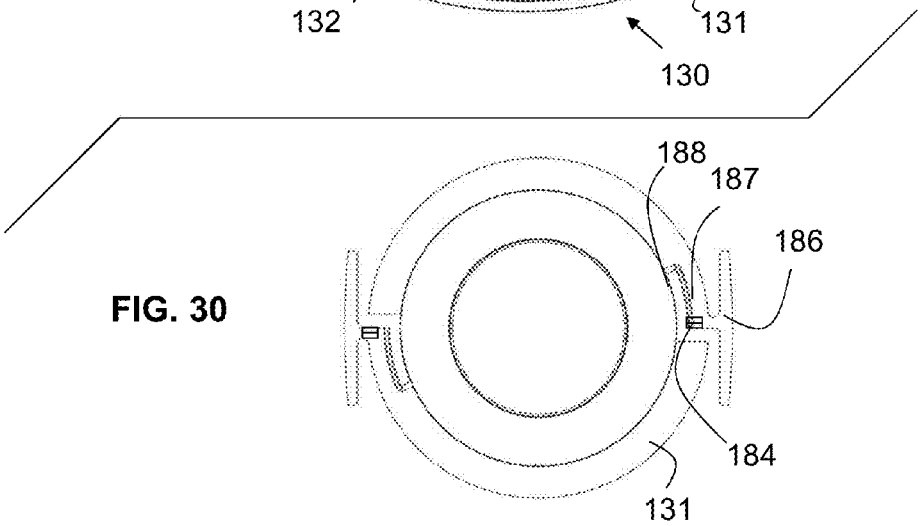
FIG. 30 is a detail view from below of the locking ring of FIG. 29.
Figure 31:
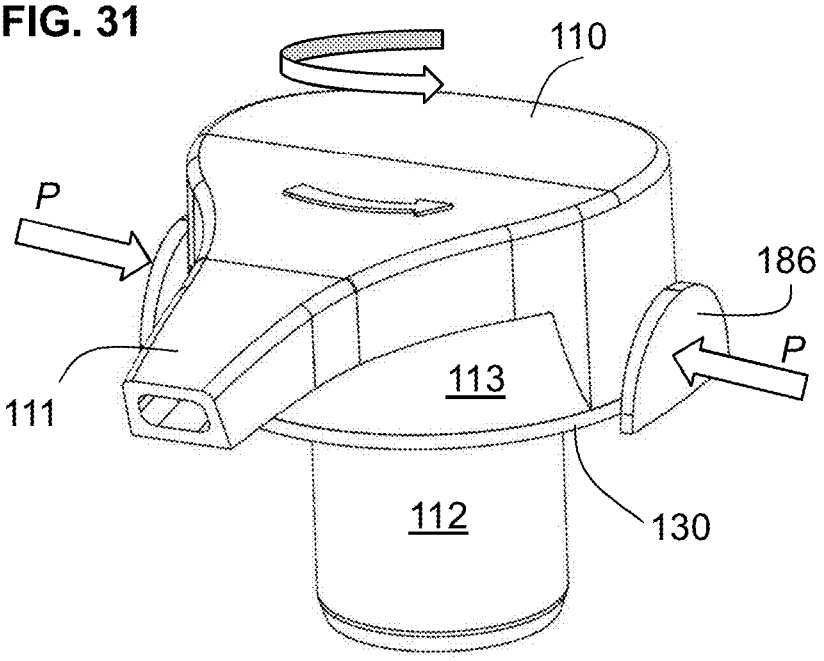
FIG. 31 is a perspective view from the front of the dispenser head and locking ring of FIG. 29, in a closed, locked position.

FIG. 29 shows a perspective view of another dispenser head 110 and locking ring 130. Here the lower edge of the dispenser head depending skirt 182 is provided with a pair of notches 182 that each receive a latch 184 projecting upward from the lower rim 131 of locking ring 130. The latches are connected to pads 186 that may be pinched inward to disengage latch 184 from notch 182. To provide some flexibility in moving the latch, the latch 184 and pad 186 may be carried on arm 187 show from above in the simplified drawing of FIG. 30. Arm 187 may essentially be part of the lower rim 131, but may be separated from the lower rim 131 by an opening 188. When pad 186 is pressed inward or downward, the arm 187 and attached latch 184 deflect inward or downward out of engagement with notch 182, so that the dispenser head 110 may be rotated and opened. FIG. 31 shows the dispenser head 110 attached to locking ring 130 in the locked position. The arrows "P" indicate a pressing or pinching force applied to pads 186 while around "R" indicates a rotational force applied to the dispenser head 110 to rotate the head free of the latches 184.

Figure 32:
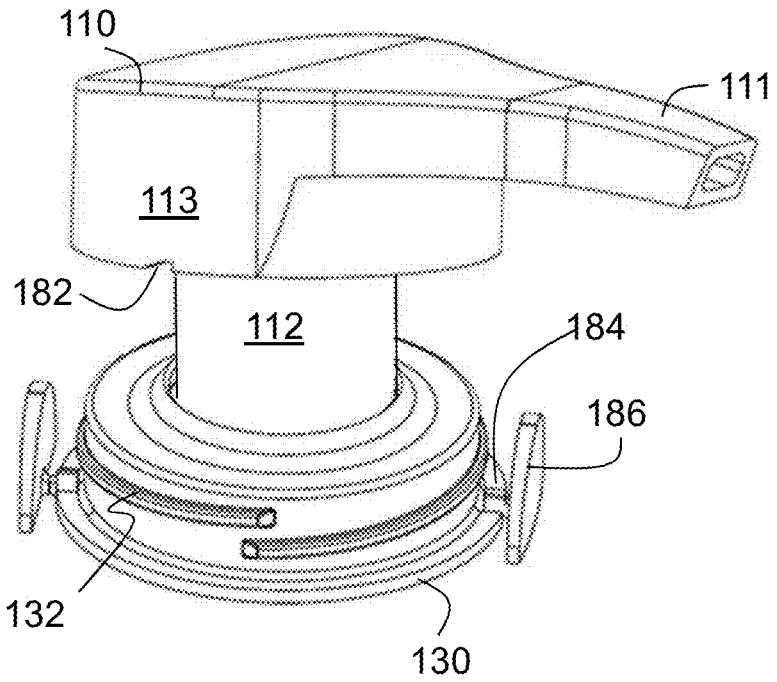
FIG. 32 is a perspective view from the side of the dispenser head and locking ring of FIG. 29, in an open position.

FIG. 32 shows the dispenser head 110 having been rotated to an open position. The dispenser head 110 may still be returned to a closed and locked position (FIG. 31) by pushing down on the dispenser head 110 and rotating it onto locking ring 130 until the latches 184 once again engage the notches 182.

Two notches 182 and two latches 184 are shown in FIGS. 29-32. However, a single notch and latch, or more than two notches and latches, may be used.

Figure 33:
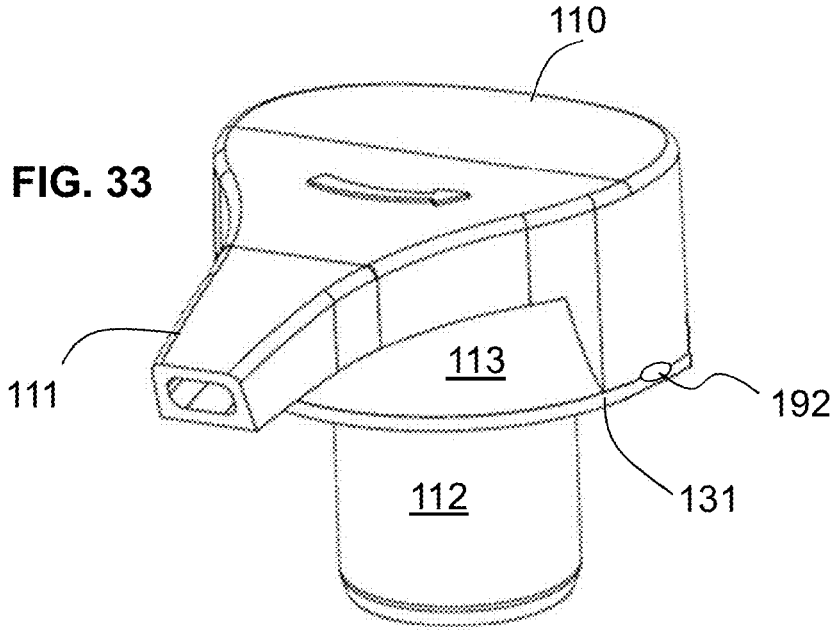
FIG. 33 is a perspective view from the front of a dispenser head and locking ring showing another method of more tightly closing a dispenser.
Figure 34:
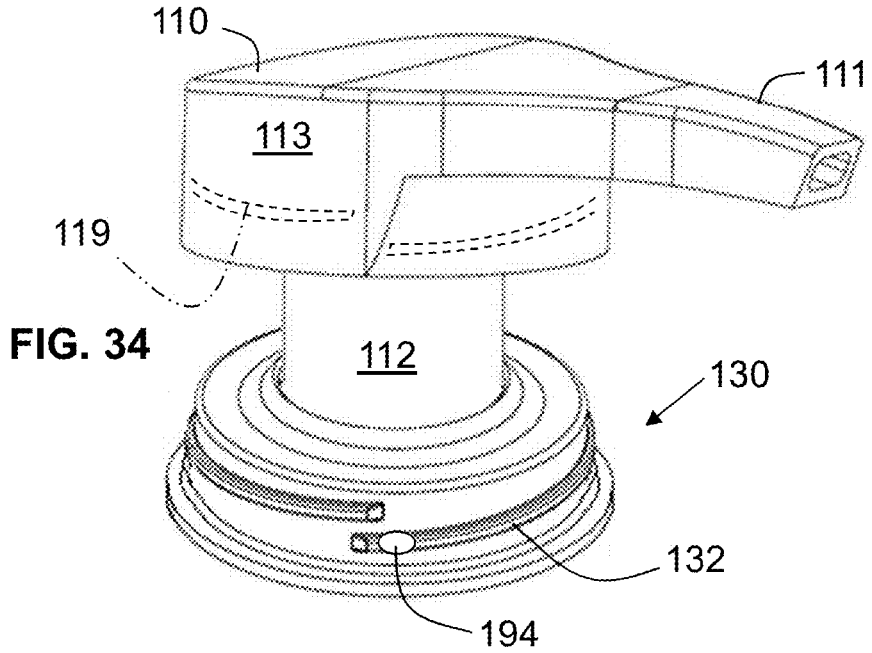
FIG. 34 is a perspective view from the side of a dispenser head and locking ring showing another method of more tightly closing a dispenser.

FIGS. 33 and 34 show embodiments that may not require any changes to the initial structure of the dispenser head 110 and locking ring 130. Instead, as shown in FIG. 33, one or more drops of adhesive 192 may be applied at the junction of the dispenser head depending skirt 113 and the lower rim 131 of the locking ring. Sufficient adhesive may be applied to provide an initial locking strength for shipment and storage. The adhesive may be nearly invisible, for example a low viscosity clear adhesive that may reside mainly within the thin space between the depending skirt 113 and lower rim 131. In the alternative, the adhesive may be readily apparent, for example with a higher viscosity, colored or opaque adhesive to provide a degree of tamper-evidence. Instead of using an adhesive, one or more areas around the junction of the depending skirt 113 and lower rim 131 may be spot welded as by a hot instrument to fuse together small areas which may provide a locking strength and a tamper-evident feature.

As shown in FIG. 34, one or more drops of adhesive 194 may be applied onto thread 132, (and/or thread 119 inside depending skirt 113) for example at its lower end. Sufficient adhesive may be applied to provide an initial locking strength for shipment and storage. Instead of using an adhesive, the area near the lower end of thread 132 or 119 may be deformed slightly as by a hot instrument or pressure to create enough interference between threads 132 and 119 (within depending skirt 113) to provide extra locking strength for the closed dispenser.

It would be appreciated by those skilled in the art that various changes and modifications can be made to the illustrated embodiments without departing from the spirit of the present invention. It would be appreciated that certain of the embodiments may be used in combinations. All such modifications and changes are intended to be within the scope of the present invention.

The invention claimed is:

1. A fluid dispenser comprising:

a dispenser head comprising
- a fluid inlet;
- a fluid outlet;
- a depending skirt;
- a locking rib on an inner surface of the depending skirt, wherein the locking rib is located above a first thread; and
- the first thread on the inside surface of the depending skirt;

a locking ring comprising
- a lower rim;
- an upper rim;
- a locking ramp on the upper rim;
- a cylindrical wall between the lower rim and upper rim; the cylindrical wall having a lower edge; and
- a second thread on the outer surface of the cylindrical wall; and an interference fit between the locking rib and the locking ramp;

wherein the dispenser head is rotatable relative to the locking ring between a lock-down position and an unlocked position;

wherein rotation of the dispenser head in a vicinity of the lock-down position requires a first torque and rotation of the dispenser head apart from the lock-down position requires a second torque, and the first torque is greater than the second torque.

2. The fluid dispenser of claim 1, further comprising a pump engine connected to the fluid inlet.

3. The fluid dispenser of claim 1, further comprising a container closure positioned beneath the locking ring.

4. The fluid dispenser of claim 3, further comprising a fluid container connected to the container closure.

5. The fluid dispenser of claim 1, further comprising at least one additional locking ramp.

6. A fluid dispenser comprising:

a dispenser head comprising a fluid inlet;

a fluid outlet;

a depending skirt; and a first thread on the inside surface of the depending skirt;

a locking ring comprising a lower rim;

an upper rim;

a cylindrical wall between the lower rim and upper rim; the cylindrical wall having a lower edge; and a second thread on the outer surface of the cylindrical wall; and an interference fit between the dispenser head and the locking ring, wherein the interference fit comprises a protrusion on the upper rim and a locking rib on the dispenser head;

wherein the locking rib is located above the first thread;

wherein the dispenser head is rotatable relative to the locking ring between a lock-down position and an unlocked position;

wherein rotation of the dispenser head in a vicinity of the lock-down position requires a greater torque than rotation of the dispenser head apart from the lock-down position.

7. The fluid dispenser of claim 6 further comprising a pump engine connected to the fluid inlet.

8. The fluid dispenser of claim 6, further comprising a fluid container connected to the dispenser head.

* * * * *